United States Patent [19]

Hohn

[11] Patent Number: 4,486,684

[45] Date of Patent: Dec. 4, 1984

[54] SINGLE CRYSTAL LANTHANUM HEXABORIDE ELECTRON BEAM EMITTER HAVING HIGH BRIGHTNESS

[75] Inventor: Fritz-Jürgen Hohn, Armonk, N.Y.

[73] Assignee: International Business Machines Corporation, Armonk, N.Y.

[21] Appl. No.: 267,319

[22] Filed: May 26, 1981

[51] Int. Cl.[3] ..... H01J 1/16; H01J 19/10

[52] U.S. Cl. ..... 313/336; 313/337; 313/346 R

[58] Field of Search ..... 313/336, 337, 346

[56] References Cited

U.S. PATENT DOCUMENTS

| | | | |
|---|---|---|---|
| 3,631,290 | 12/1971 | Loeffler | 313/341 |
| 3,817,592 | 6/1974 | Swanson | 316/26 |
| 4,054,946 | 10/1977 | Ferris et al. | 313/336 |
| 4,055,780 | 10/1977 | Kawai et al. | 313/336 |
| 4,363,995 | 12/1982 | Takigawa et al. | 313/326 |
| 4,430,570 | 2/1984 | Takigawa et al. | 313/336 |

FOREIGN PATENT DOCUMENTS

| | | | |
|---|---|---|---|
| 51-41951 | 4/1976 | Japan | 313/336 |
| 30151 | 3/1977 | Japan | 313/336 |
| 31650 | 3/1977 | Japan | 313/336 |
| 51473 | 4/1979 | Japan | 313/336 |
| 24371 | 2/1980 | Japan | 313/336 |
| 30465 | 6/1981 | Japan | 313/336 |
| 56-93244 | 7/1981 | Japan | 313/336 |
| 56-84842 | 7/1981 | Japan | 313/336 |

*Primary Examiner*—Saxfield Chatmon

*Attorney, Agent, or Firm*—Ronald L. Drumheller

[57] ABSTRACT

I have discovered that an electron beam emitted from an $LaB_6$ single crystal cathode has higher brightness when a significant portion of the actual emitting surface of the $LaB_6$ crystal comprises flat surfaces oblique to the electron beam axis and when these flat surfaces expose relatively low work function crystal planes. I have defined as a relatively low work function crystal plane those crystal planes having a lower work function than the average work function for sintered $LaB_6$. My preferred geometry for a single crystal $LaB_6$ electron emitting tip is a pyramid oriented such that the apex points in the electron beam emission direction and preferably also points in a direction perpendicular to a relatively low work function crystal plane. The pyramidal tip may have three, four, or more flat sides, all of which contribute electrons to the beam, from at least an area in the vicinity of the apex. The apex of the pyramid may be rounded or flat. Relatively low work function crystal planes include the (100), (110), (111), (210), (321), and (311) crystal planes, but additional relatively low work function crystal planes which have not yet been tested probably exist. In general, the brightness of any single crystal $LaB_6$ cathode may be improved by facetting the emitting tip with flat surfaces so as to expose relatively low work function crystal planes. However, highest brightnesses occur when the emitted electron beam is perpendicular to and the flat surfaces expose the lowest work function crystal planes.

18 Claims, 20 Drawing Figures

FIG. 1.1
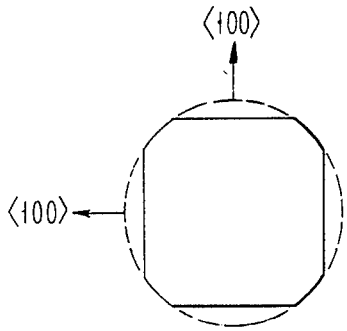
FIG. 1.2
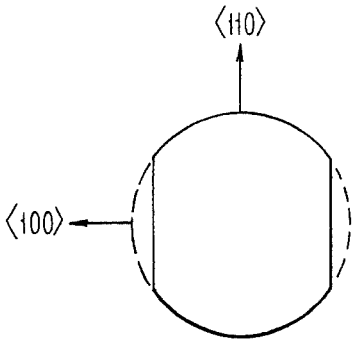
FIG. 1.3
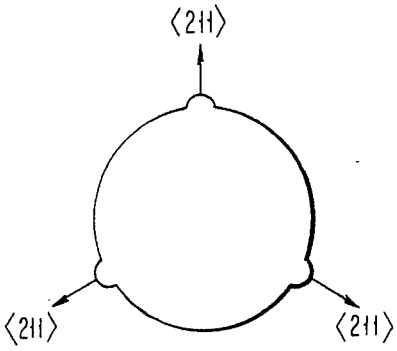

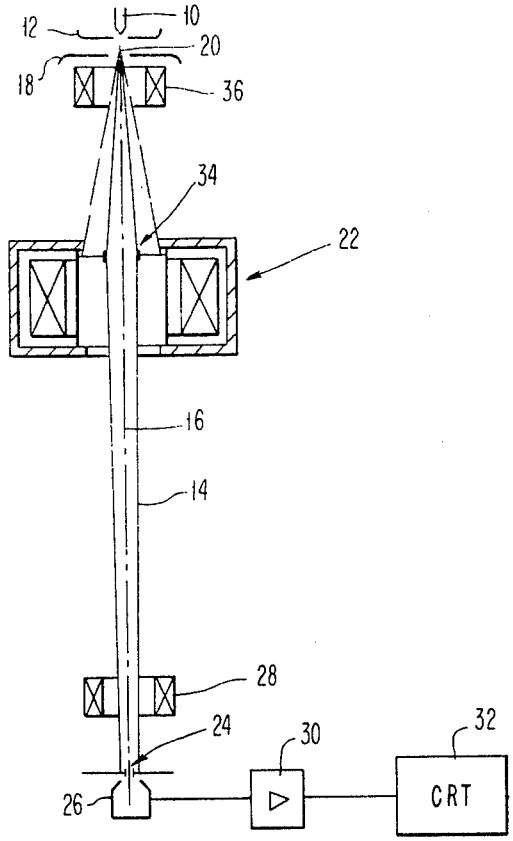
FIG. 2.1
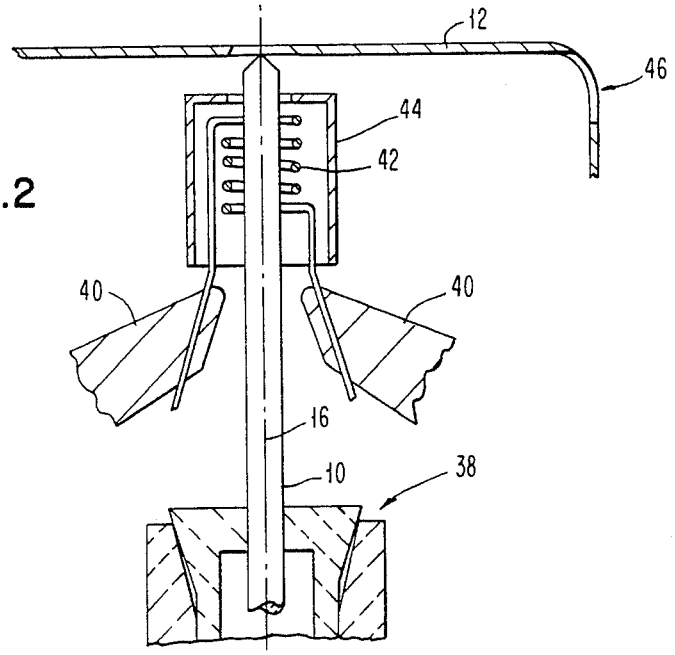
FIG. 2.2

FIG. 4.1
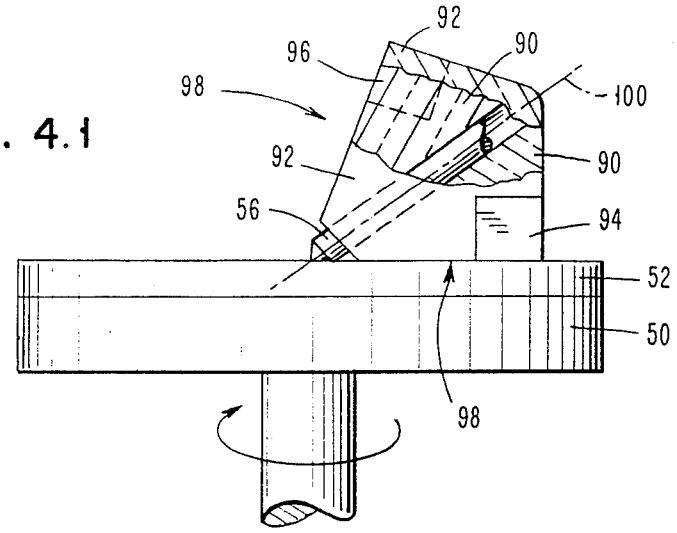
FIG. 4.2
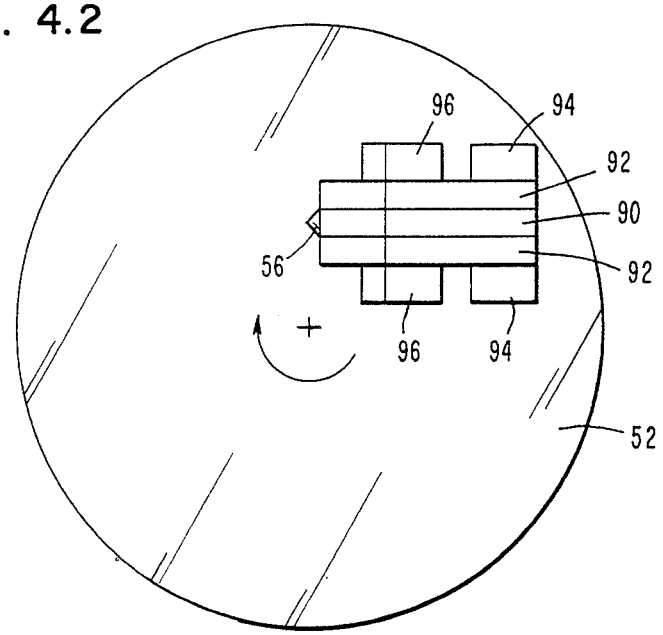

FIG. 5.1
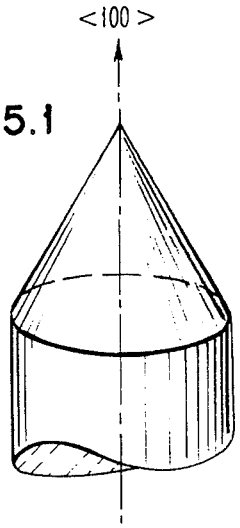
FIG. 5.2
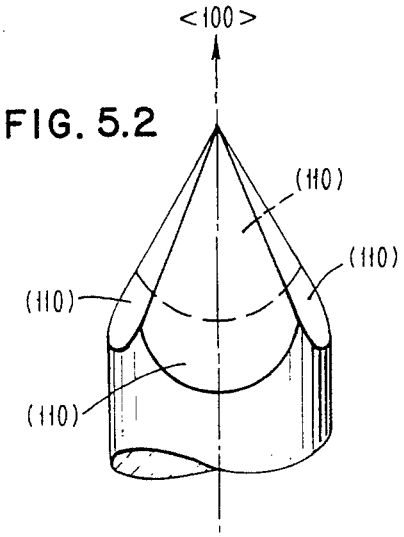
FIG. 5.3
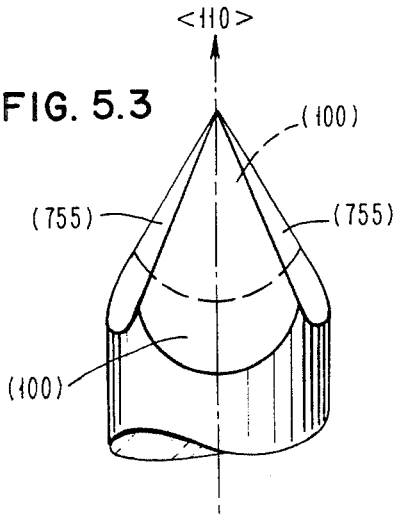
FIG. 5.4
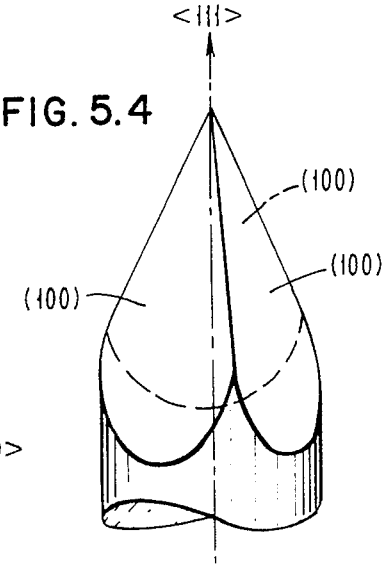
FIG. 5.5
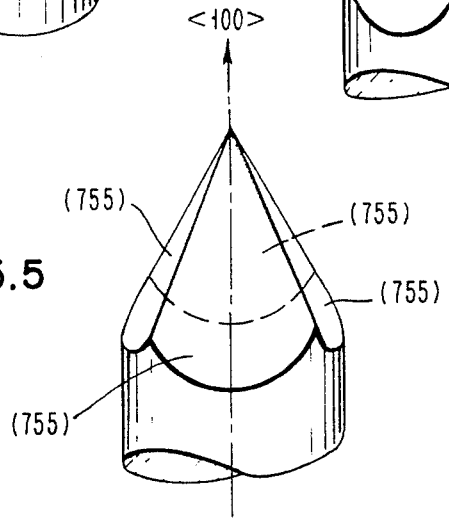

FIG. 11.1
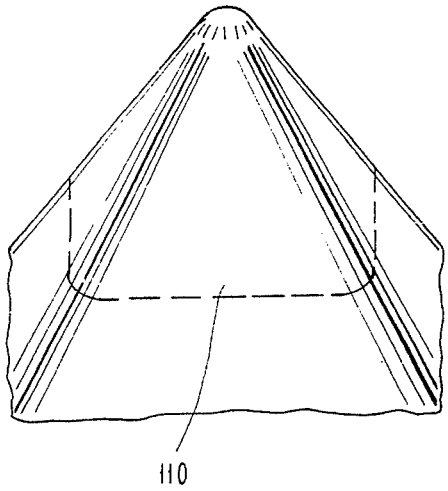
FIG. 11.2
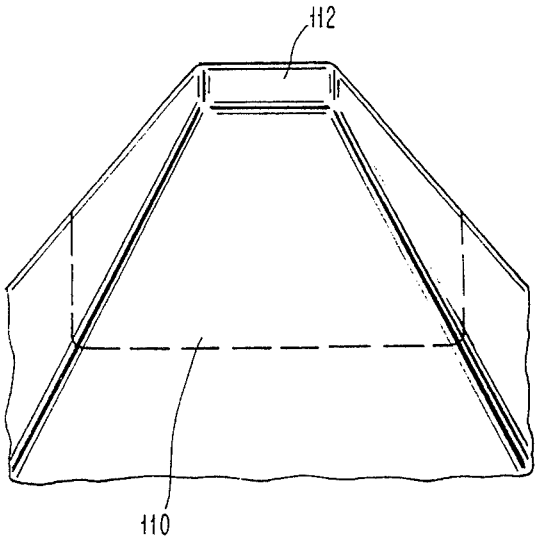

SINGLE CRYSTAL LANTHANUM HEXABORIDE ELECTRON BEAM EMITTER HAVING HIGH BRIGHTNESS

DESCRIPTION

1. Technical Field

This invention relates generally to electron beam emitting materials, and more particularly it relates to single crystal lanthanum hexaboride electron beam emitters.

2. Background Art

Many modern electron beam systems such as scanning electron microscopes and electron beam lithography tools require a highly reliable, long life electron beam source which can produce a small but very bright and highly stable electron beam.

The conventional material used for a thermionic electron emission cathode is tungsten. Lanthanum hexaboride ($LaB_6$) also has been used because it has a lower work function, higher melting temperature, and lower vapor pressure than tungsten Thus, $LaB_6$ cathodes promise higher brightness at the same operating temperature and pressure, and longer life.

U.S. Pat. No. 4,055,780 describes a thermionic electron emission cathode fabricated from a single crystal of lanthanum hexaboride as opposed to sintered lanthanum hexaboride material. Single crystal $LaB_6$ provides higher brightness than sintered $LaB_6$. Holders for $LaB_6$ cathodes are described in U.S. Pat. No. 3,462,635, U.K. Pat. GB No. 2,003,655A, and in Crawford, "Mounting Methods and Operating Characteristics for $LaB_6$ Cathodes", Proc. SEM Conf. I 19-30 (1979). which are hereby incorporated by reference.

U.S. Pat. No. 4,054,946 reports that $LaB_6$ crystal orientation affects electron emission current. The highest emission current was said to be obtained from single crystal $LaB_6$ oriented with its emitting face defined by a (110) crystal plane.

A detailed report of the emission behavior of single crystal $LaB_6$ as a function of crystallographic orientation may be found in Hohn et al., "The Emission Behavior and Brightness of Single Crystal $LaB_6$ Cathode Materials", and in Verhoeven et al., "Influences of Crystallography and Purity on Brightness of $LaB_6$ Cathodes", 47 Jour. Appl. Phys. 5105-06 (1976). Both of these reports conclude that the <100> orientation results in higher brightness than other orientations tested.

The work function of $LaB_6$ and more particularly the dependence of work function upon crystallographic orientation is reported in articles such as: Yamanchi et al., "Work Function of $LaB_6$", 29 Appl. Phys. Lett. 638-40 (1976); Storms et al., "A Study of Surface Stoichiometry and Thermionic Emission Using $LaB_6$", 50 Jour. Appl. Phys. 3691-98 (1979); Aono et al., "Direct Observation of $LaB_6$(001) Surface at High Temperatures by X-Ray and Ultraviolet Photoelectron Spectroscopy, Low-Energy Electron Diffraction, Auger Electron Spectroscopy, and Work-Function Measurements", 50 Jour. Appl. Phys. 4802-07 (1979); Oshima et al., "Low Work Function and Surface Structure of the $LaB_6$(210) Surface Studied by Angle-Resolved X-Ray Spectroscopy, Ultraviolet Spectroscopy, and Low Energy Electron Diffraction", 51 Jour. Appl. Phys. 997-1000 (1980); and Nishitani et al., "Surface Structures and Work Functions at the $LaB_6$(100), (110) and (111) Clean Surfaces", 93 Surface Science 535-49 (1980).

Prior art electron beam emission cathodes of lanthanum hexaboride have a rod shape with a pointed end. These rods have a round or a polygonal cross-section or a combination of the two, depending mostly upon the method of fabrication. The pointed end has a round cross-section of decreasing size (usually a geometrical cone) ending at the apex with a spherical tip having a radius of curvature as small as possible, usually in the range of about 1-10 μm. No suggestion can be found in the prior art that any other geometrical shape for the pointed end or tip might improve performance in any way or raise brightness in particular.

DISCLOSURE OF THE INVENTION

I have discovered that an electron beam emitted from an $LaB_6$ single crystal cathode has higher brightness when a significant portion of the actual emitting surface of the $LaB_6$ crystal comprises flat surfaces oblique to the electron beam axis and when these flat surfaces expose relatively low work function crystal planes. I have defined as a relatively low work function crystal plane those crystal planes having a lower work function than the average work function for sintered $LaB_6$. My preferred geometry for a single crystal $LaB_6$ electron emitting tip is a pyramid oriented such that the apex points in the electron beam emission direction and preferably also points in a direction perpendicular to a relatively low work function crystal plane. The pyramidal tip may have three, four, or more flat sides, all of which contribute electrons to the beam, from at least an area in the vicinity of the apex. The apex of the pyramid may be rounded or flat. Relatively low work function crystal planes include the (100), (110), (111), (210), (321), and (311) crystal planes, but additional relatively low work function crystal planes which have not yet been tested probably exist. In general, the brightness of any single crystal $LaB_6$ cathode may be improved by facetting the emitting tip with flat surfaces so as to expose relatively low work function crystal planes. However, highest brightnesses occur when the emitted electron beam is perpendicular to and the flat surfaces expose the lowest work function crystal planes.

BRIEF DESCRIPTION OF THE DRAWINGS

FIG. 1.1 is a cross-sectional view of a <100> oriented $LaB_6$ rod formed by the floating zone method with heating by laser.

FIG. 1.2 is a cross-sectional view of a <110> oriented $LaB_6$ rod formed by the floating zone method with heating by laser.

FIG. 1.3 is a cross-sectional view of a <111> oriented $LaB_6$ rod formed by the floating zone method with heating by laser.

FIG. 2.1 schematically illustrates the electron gun test apparatus used in the described experiments.

FIG. 2.2 is an inverted and enlarged cross-sectional view of the electron gun shown in FIG. 2.1.

FIG. 4.1 is a partly broken away side view at another crystal grinding apparatus used to form facets on $LaB_6$ single crystal rod cathodes.

FIG. 4.2 is a top view of the apparatus of FIG. 4.1.

FIG. 5.1 is a perspective view of the end portion of a <100> oriented single crystal $LaB_6$ rod cathode illustrating a cone shaped tip.

FIG. 5.2 is a perspective view of the end portion of a <100> oriented single crystal $LaB_6$ rod cathode illustrating a four side pyramidal shaped tip exposing four (110) crystal planes.

FIG. 5.3 is a perspective view of the end portion of a <110> oriented single crystal $LaB_6$ rod cathode illustrating a four side pyramid shaped tip exposing two (100) crystal planes and two (755) crystal planes.

FIG. 5.4 is a perspective view of the end portion of a <111> oriented single crystal $LaB_6$ rod cathode illustrating a three side pyramid shaped tip exposing three (100) crystal planes.

FIG. 5.5 is a perspective view of the end portion of a <100> oriented single crystal $LaB_6$ rod cathode illustrating a four side pyramid shaped tip exposing four (755) crystal planes.

FIG. 11.1 is an enlarged view of a four side pyramidal tip illustrating a rounded apex and rounded facet edges.

FIG. 11.2 is an enlarged view of a four side pyramidal tip illustrating a flat apex and less rounded facet edges.

DESCRIPTION OF THE PREFERRED EMBODIMENTS

Figure 3:
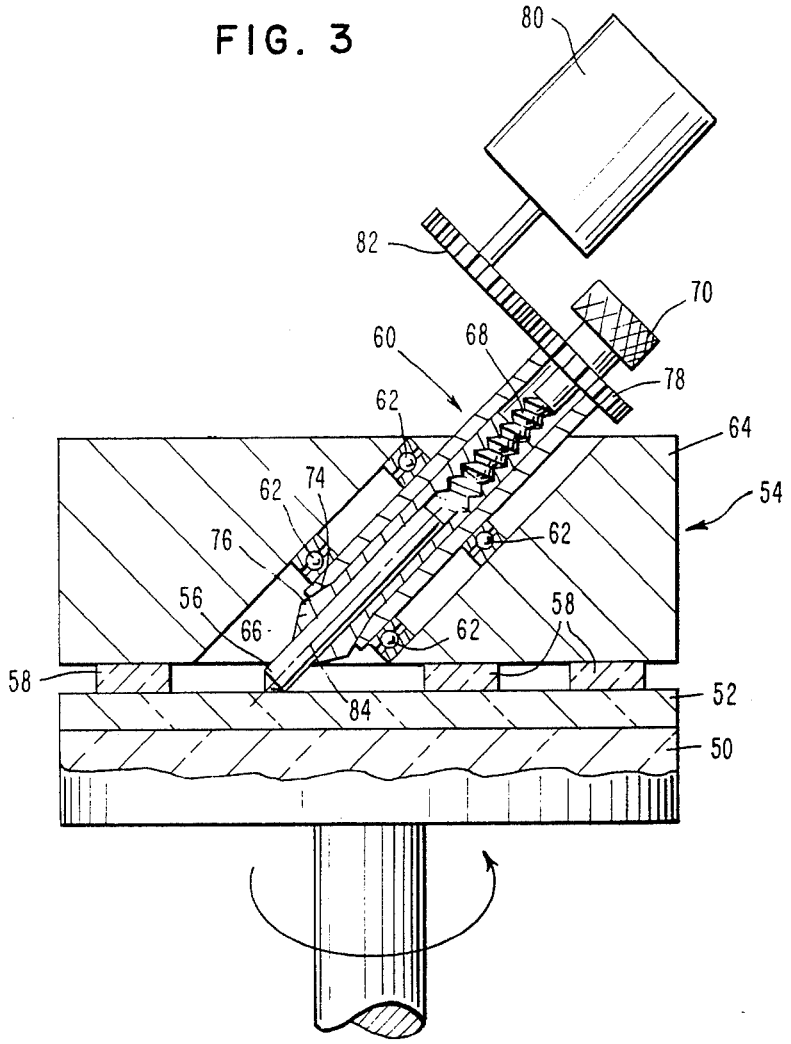
FIG. 3 is a cross-sectional view of crystal grinding apparatus used to form cone shaped and facetted tips on $LaB_6$ single crystal rod cathodes.

Single crystal $LaB_6$ suitable for practicing my invention may be formed by any method. At least four different methods are known. The induction heated floating zone method produces large grained polycrystalline $LaB_6$ from which single crystal samples can be cut or machined. Using multiflat zone geometry with this method, large high purity boules having essentially single crystal structure have been obtained. This method is described in more detail in Tanaka et al., "Growth of High Purity $LaB_6$ Single Crystals by Multi-Float Zone Passage", 30 J. Crystal Growth 193–197 (1975).

High yields of single crystal $LaB_6$ rods, plates, and cubes may be obtained using the metal flux method, in which an aluminum melt containing lanthanum and boron is slowly cooled through the liquidus. After solidification, the aluminum matrix is dissolved with HCl. This method is described in further detail in Futamoto et al., "Crystallographic Properties of $LaB_6$ Formed in Molten Aluminum", 14 Japan J. Appl. Phys. 1263–1266 (1975).

Larger size single crystal rods of $LaB_6$ may be grown by using the floating zone method with heating by an electric arc. Sintered feedstock is melted by an electric arc from a tungsten electrode. The resolidified $LaB_6$ is purified by the zone melting process and automatically becomes monocrystalline after the first few millimeters of growth. It may be seeded also to a desired crystallographic orientation. This method is described in detail in Verhoeven et al., "An Arc Floating Zone Technique for Preparing Single Crystal $LaB_6$", 36 J. Crystal Growth 115–120 (1976).

The crystal growth method I prefer and the one used to produce the $LaB_6$ single crystals for the experiments I describe is the floating zone method with heating by laser. This general method is described in U.S. Pat. No. 3,944,640 and application of this method to the growth of single crystal $LaB_6$ is described in particular detail in Takagi et al., "Growth of $LaB_6$ Single Crystals by a Laser Heated Floating Zone Method", 40 J. Crystal Growth 1–5 (1977) both of which are hereby incorporated by reference.

Briefly, the floating zone system employed to fabricate my crystals utilizes continuous wave laser radiation from a $CO_2$ laser (10.6 μm wavelength) with a 500 W maximum output. The laser beam is split into two beams which are transmitted through KCL windows into a growth chamber. The two halves of the laser beam are focused to the same diameter (approximately 1.5 mm) at a point in space which defines the location of the molten zone. A single crystal seed and polycrystalline feed rod are attached to pulling shafts by chucks mounted on goniometers. Alignment of the seed to a specific crystallographic orientation is achieved by means of the Laue back-reflection method. The feed rod is positioned so that its axis is perfectly vertical and extends through the point defined by the intersection of the laser beams.

Feed rods of 2.16 mm diameter were cut from hot-pressed disks of $LaB_6$ obtained from the Haselden Corp. Prior to use, the feed rods were degreased and cleaned to remove any impurities introduced during machining. A piece of feed rod and an oriented $LaB_6$ seed are then mounted in holders and aligned, the growth chamber is sealed, evacuated to 20 torr and backfilled with argon to a slightly positive pressure to prevent oxidation of the $LaB_6$ during growth. Because $LaB_6$ poorly absorbs 10.6 μm radiation, the molten zone was partly surrounded with a gold plated spherical radiation shield to reflect laser and emitted blackbody radiation back into the molten zone.

Growth is initiated by lowering the tip of the feed rod into the laser beams and forming a molten drop. The seed is then raised until it touches the drop, which wets the seed. The seed is pulled from the molten zone at a selected rate with the feed rod advancing into the zone to maintain a constant zone volume. The growth rate for most crystals was 2 in/hr (5.1 cm/hr). During growth, the feed rate of the polycrystalline feedstock was adjusted to account for a diameter attenuation ratio of 2:1 as well as vaporization losses. As the run progresses, $LaB_6$ gradually is deposited on the surface of the radiation shield, which continually decreases its reflectance. The resulting decrease in power to the melt zone is balanced by continually increasing the power of the incident laser beam so that the net power input is relatively constant.

The sintered $LaB_6$ billets received from the Haselden Corp. were found to be single phase by x-ray diffraction analysis and contained low levels of Ta, Ni, and Fe as measured by x-ray fluorescence. Metallographically polished samples revealed a random distribution of small, metallic inclusions 2 to 10 μm in size. Analysis by EDAX in an SEM indicated the particles to be primarily composed of Ta, with lower quantities of Fe, Ni, and Cr (comparable in composition to an 18–8 stainless steel).

Single crystal fibers corresponding to several orientations were grown. Because of natural faceting at the periphery, cross-sections through a fiber are not necessarily circular. Typical examples are shown in FIG. 1.1, 1.2, and 1.3, which illustrate the rod cross-sections for <100>, <110>, and <111> oriented rods respectively.

In order to test the performance of $LaB_6$ rod cathodes, a test system was set up to measure brightness, cathode temperature, cross-over intensity distribution and angular emission distribution. FIG. 2.1 schematically illustrates the electron gun test apparatus used in my experiments. A lanthanum hexaboride rod cathode 10 positioned behind a wehnelt electrode 12 emits an electron beam 14 along axis 16 of a one lens magnifying electron optical column. The column includes an anode 18 positioned in the vicinity of the electron beam cross-over 20. The cross-over is magnified 7.7 times by lens 22 into the plane of a 5 μm diameter pin-hole aperture 24. A Faraday cup or a scintillator device 26 is positioned behind the pin-hole aperture to collect electrons passing through the pin-hole aperture. Deflection coils 28 scan the focused electron beam over the pin-hole aperture so that the intensity distribution of the cross-over can be obtained. The signal detected by device 26 is amplified by device 30 and imaged onto a CRT screen 32. The angular emission is obtained instead by scanning the whole emitted beam across the in-lens aperture 34 using deflection coils 36. The pin-hole aperture 24 and detector 26, amplifier 30, and CRT 32 are also used to measure brightness by the following relationship:

$$\text{Brightness} = I_c / A\pi\alpha^2$$

where $I_c$ (ampere) is the current collected through the pin-hole aperture 24. A ($cm^2$) is the area of the pin-hole aperture, and $\alpha$ (radian) is the beam semiconvergent angle as defined by the in-lens aperture 34. In order to minimize errors that may be introduced by the lens aberrations, the beam defining aperture 34 is kept very small ($\alpha \sim 10^{-5}$rad). With an in-lens aperture, the electron rays will still be influenced by the magnetic field after passing through the aperture. Thus an artifically enlarged aperture must be taken into account. Since the lens 22 is a weak lens of high focal length, however, the error introduced by the post aperture field is very small and has been corrected for in the graphs. Magnification in conjunction with a pin-hole aperture ensures that only the center portion of the intensity distribution is collected during the brightness measurement. This is important because the intensity distribution is generally Gaussian. A low magnification in conjunction with a large measuring aperture would result instead in incorrectly low brightness values.

FIG. 2.2 is an inverted and enlarged cross-sectional view of the electron gun showing electron beam cathode 10 supported by a collet type holder 38 and positioned close to wehnelt grid 12. Input leads 40 support and electrically drive tungsten wire heating coil 42. Heat shield 44 allows a lower input current for the same tip temperature. Because emission behavior is very dependent upon the temperature of the emitter, viewing port 46 in the wehnelt grid and gun housing allows the tip temperature to be accurately measured with an automatic pyrometer (not shown) during gun operation. All of my experiments were conducted using this gun arrangement.

The cathodes used in my measurements were single crystal rods of about 20 mm length and 1 mm diameter. The tip geometry was deliberately varied. Several crystallographic orientations were studied. For comparative purposes a sintered rod type $LaB_6$ cathode was also evaluated. Each cathode tip was prepared by using glass polishing techniques. Initially, a cone with 90° included angle was ground on the tip of each cathode by axially rotating the cathode at an inclined angle of 45° with respect to a polishing disk.

The apparatus shown in FIG. 3 was used to form a cone shaped tip. A rotating table 50 supports a glass polishing disk 52. A disk type holder 54 supports the $LaB_6$ single crystal rod 56 to be ground. Replenishable pieces of glass 58 are attached to the bottom plane of the holder and are ground away at the same time that the $LaB_6$ rod is ground. As a result, the grinding process is very gradual which prevents mechanical damage to the cone surface. The crystal rod 56 is held by a chuck 60 which is rotatably supported by the holder base 64 via ball bearings 62. Jaws 66 of chuck 60 have inside threads which engage screw 68 having knob 70. When knob 70 is turned, jaws 66 move in the axial direction. Chuck collar 72 has an inside inclined surface 74 which engages an exterior inclined surface 76 of jaws 66 to force jaws 66 together as they are drawn toward knob 70. Collar 72 is mounted to a first gear 78, which is driven by motor 80 via second gear 82. Motor 82 thus rotates chuck 60 and also the crystal rod 56 held by chuck 60. Axis 84 of crystal rod 65 is inclined 45° with respect to grinding disk 52 so that a cone tip is formed on the end of rod 56 having an included angle of 90° (45° included angle between the cone side surface and the rod axis). Obviously mechanical modifications could be made which would allow variation in the angle of inclination and thus also in the cone included angle. A flat surface (facets) is formed merely by turning off or disengaging motor 80 for a period of time.

FIGS. 4.1 and 4.2 illustrate another method for grinding facets on the tip of an $LaB_6$ single crystal rod. A different holder is used in this case. Two pieces of glass 90 having a thickness equal to the diameter of the crystal rod 56 hold the rod between them in one dimension while these pieces 90 as well as the crystal rod are held in an orthogonal direction between two additional pieces of glass 92. All of this structure is temporarily bonded together using bees wax. Additional blocks 94 of glass are bonded to the sides of pieces 92 to reduce the rate at which grinding occurs. A second pair of blocks 96 are provided along the opposite edge for grinding a second opposing facet. Edges 98 are sufficiently flat such that the holder rests with stability on grinding disk 52 and are inclined with respect to the rod axis 100 at a desired angle. After each two facets are ground, the assembly is unbonded, the crystal is rotated and the structure is reassembled and bonded again to form another two facets. This is a very time consuming method and was used only to form experimental facets at oblique angles to the crystal axis other than 45°. It should be noted that the position of the holder is such that polishing occurs in a direction towards the apex of the crystal tip. This direction was also used with the apparatus of FIG. 3 and results in sharper tips (lower radius of curvature) and less mechanical damage.

Throughout this application a specifically oriented rod such as a <100> oriented rod will mean that the rod axis is aligned with or parallel to a <100> crystallographic axis. A specific crystal axis, such as a <100> crystal axis, by definition is perpendicular or normal to that crystal plane, a (100) crystal plane in this example. Cathodes were prepared from rods having six different crystallographic orientations, namely <100>, <110>, <111>, <321>, <210>, and <311> orientations.

Some cathodes were tested with a ground cone shaped tip. Others were further modified by facetting the cone tips. This was done also by grinding. The cathode must be rotationally positioned properly for each flat surface or facet. Axial orientation of the crystal was determined by reference to the natural structure which forms along the side surface of a grown fiber itself. For example, as shown in FIG. 1.1, a <100> oriented fiber develops natural flat side surfaces aligned with the (100) crystal planes. The orientation of these naturally formed flat surfaces was verified by x-ray diffraction. FIG. 1.2 illustrates the two flat surfaces which naturally form along the (100) crystal planes when a <110> oriented fiber is formed by the floating zone method with laser heating. FIG. 1.3 shows the three longitudinal ridges which form when a <111> oriented $LaB_6$ fiber is formed by this method. X-ray diffraction confirms that the ridges correspond in axial position with the <211> directions.

Using the apparatus shown in FIG. 3, the cathodes illustrated in FIGS. 5.1–5.5 were prepared. The tip illustrated in FIG. 5.4 was initially formed into a cone shape using the FIG. 3 apparatus and then facetted using the apparatus shown in FIGS. 4.1–4.2. All of the pyramidal shapes were formed first by making a cone shaped tip and then facetting the cone shaped tip. The radius of curvature of the apex of all of these tips was 2–3 μm.

FIG. 5.1 illustrates a <100> oriented cone shaped tip with the axis of the cone oriented in the <100> direction, which coincides with the rod axis.

FIG. 5.2 shows a pyramidal tip ground on the end of a <100> oriented rod. The axis of the pyramid (the direction in which the pyramid points) is oriented in the <100> direction which coincides with the rod axis. The crystal was oriented so that each of the four sides of the pyramidal tip coincides with and exposes a (110) crystal plane. For ease of illustration and in order to emphasize the importance only of the tip geometry, the cross-section of the rod is shown as circular. Any convenient rod cross-section could be used instead. It should be understood that in reality the cross-section of my <100> oriented rods was as shown in FIG. 1.1.

FIG. 5.3 again illustrates a pyramidal tip ground this time on the end of a <110> oriented rod. The axis of the pyramid (direction in which it points) is oriented in the <110> direction, which again coincides with the rod axis. The crystal was oriented so that two of the four sides of the pyramidal tip coincide with and expose (100) crystal planes. The two other sides of the pyramidal tip coincide with and expose (755) crystal planes. For ease of illustration again and in order to emphasize the importance only of the tip geometry, the cross-section of the rod is shown as circular. Any convenient rod cross-section could be used instead. It should be understood that in reality the cross-section of my <110> oriented rods was as shown in FIG. 1.2.

FIG. 5.4 also shows a pyramidal tip ground this time on the end of a <111> oriented rod. This pyramidal tip has three rather than four sides. The axis of the pyramid is oriented in the <111> direction, which also coincides with the rod axis. The crystal was oriented such that each of the three sides of the pyramidal tip coincides with and exposes a (100) crystal plane. For ease of illustration again and in order to emphasize the importance only of the tip geometry, the cross-section of the rod is shown as circular. Any convenient rod cross-section could be used instead. It should be understood that in reality the cross-section of my <111> oriented rods was as shown in FIG. 1.3. In all of the previously described pyramidal tip configurations, the included angle between a pyramid side and the pyramid axis is 45°, which corresponds exactly with the included angle between the side and the axis of the cone shaped configurations also tested. In the example shown in FIG. 3.4, however, the included angle is only about 35.7°. This included angle results when (100) crystal planes are exposed on a <111> oriented rod. In this case the rod is inclined about 35.7° during facet grinding rather than 45°.

FIG. 5.5 illustrates a different pyramidal tip ground on the end of a <100> oriented rod. The axis of this pyramid is still oriented in the <100> direction, which coincides with the rod axis. However, this time the crystal was axially oriented such that each of the four flat sides of the pyramidal tip coincides with and exposes a (755) crystal plane. The included angle between a side of this pyramidal tip and the pyramid axis is also 45°.

Figure 6:
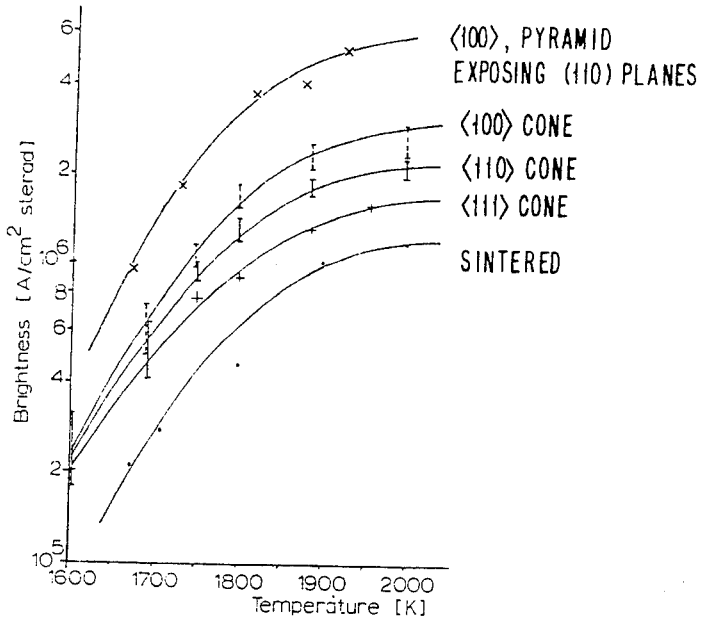
FIGS. 6–10 are graphs comparing the measured brightnesses of electron beams emitted from each of the $LaB_6$ cathodes illustrated in FIGS. 5.1–5.5 and from $LaB_6$ cathodes having a cone shaped tip but crystallographic orientations other than illustrated in FIG. 5.1.

FIG. 6 is a graph comparing measured brightness as a function of temperature for the <100> rod cathode and for two other single crystal $LaB_6$ rod cathodes having a similar cone shaped tip but different orientations. A spread in measured values for different samples of the same type is indicated by vertically extended measurement ranges rather than discrete points. This graph also compares these measured brightnesses on the one hand with a cathode rod of sintered $LaB_6$ material having a similar cone shaped tip and on the other hand with the <100> oriented $LaB_6$ cathode rod with a pyramidal tip illustrated in FIG. 5.2. All of these brightnesses were measured for a 20 kV electron beam at 200 μA. As shown the lowest brightness is for a sintered rod. The single crystal cathode rods having a cone shaped tip are significantly brighter than the sintered rod, the <100> oriented rod representing about a three-fold improvement in brightness, followed with less improvement in brightness by the <110> oriented rod and then the <111> oriented rod. The single crystal cathode rod having a pyramidal tip, however, has the highest brightness of all. The <100> oriented pyramidal tip has about a three-fold higher brightness than the same <100> oriented cone shaped tip. Since both of these tips had a similar apex, namely a spherically shaped apex of 2–3 μm radius, the improvement in brightness is attributed to the flat side surfaces or facets. These results have turned out to be repeatable and have been verified by and better understood through detailed study of cross-over intensity distributions and angular emission distributions using the test apparatus illustrated in FIGS. 2.1 and 2.2.

Figure 7:
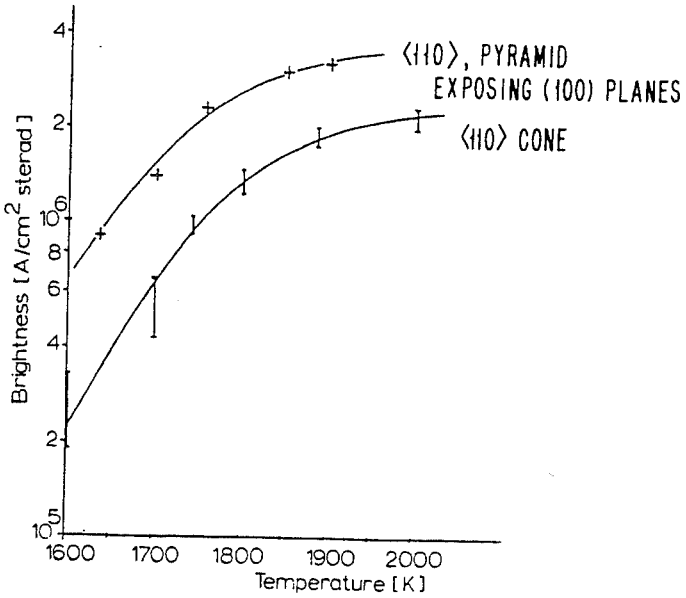

FIG. 7 is a graph comparing measured brightness as a function of temperature for a <110> oriented single crystal $LaB_6$ rod cathode having a cone shaped tip with the similarly oriented single crystal $LaB_6$ rod having a pyramidal tip illustrated in FIG. 5.3. Vertically extended measurement ranges are shown again with the <110> oriented cone tip curve. The single crystal cathode having the pyramidal tip has a brightness about twice the brightness of the same <110> oriented rod having a cone shaped tip. All of these brightnesses were measured at 20 kV and 200 μA. Since both of these tips had a similar apex, namely spherical with a 2–3 μm radius, the improvement in brightness is attributed to the flat side surfaces or facets.

The cross-over intensity distribution and the angular emission distribution of the pyramidal tips can and have been studied in detail because the beam contributions from each of the individual facets can be individually studied, particularly at lower operating temperatures. It was noted in the case of the <110> oriented pyramidal tip illustrated in FIG. 5.3 that relatively large beam contributions occurred from the (100) facets and relatively small beam contributions occurred from the (755) facets. I have attributed this to the relatively low work function of a (100) crystal plane and the relatively high work function of a (755) crystal plane. It is apparent to me from these studies that the tip shown in FIG. 5.3 would have had no lower brightness if the (755) facets had not been formed (i.e., if these regions of the tip had remained conical in shape). In fact, my observations lead me to believe that this partly facetted and partly conical configuration would have higher brightness than the fully facetted configuration illustrated in FIG. 5.3.

Figure 8:
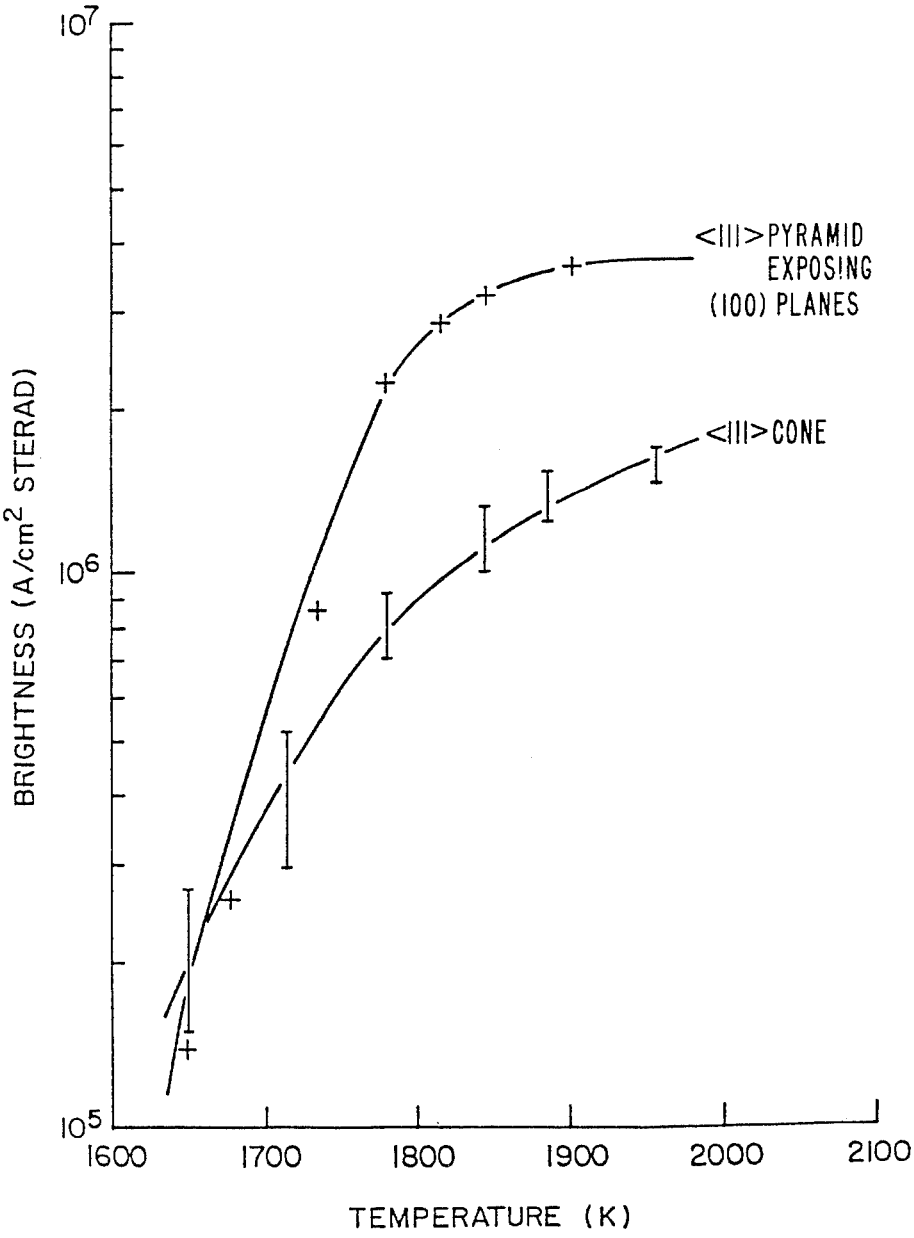

FIG. 8 is a graph comparing measured brightness as a function of temperature for a <111> oriented single crystal $LaB_6$ rod cathode having a cone shaped tip with the similarly oriented single crystal $LaB_6$ rod having a pyramidal tip illustrated in FIG. 5.4. Vertically extended measurement ranges are shown here with the <111> oriented pyramidal tip to illustrate the degree of repeatability. All of the brightnesses were again measured at 20 kV and 200 μA. Since both of these tips again had a similar apex, namely spherical with a 2–3 μm radius, the 2–3 fold improvement in brightness for the pyramidal tip configuration is attributed to the flat side surfaces or facets.

Figure 9:
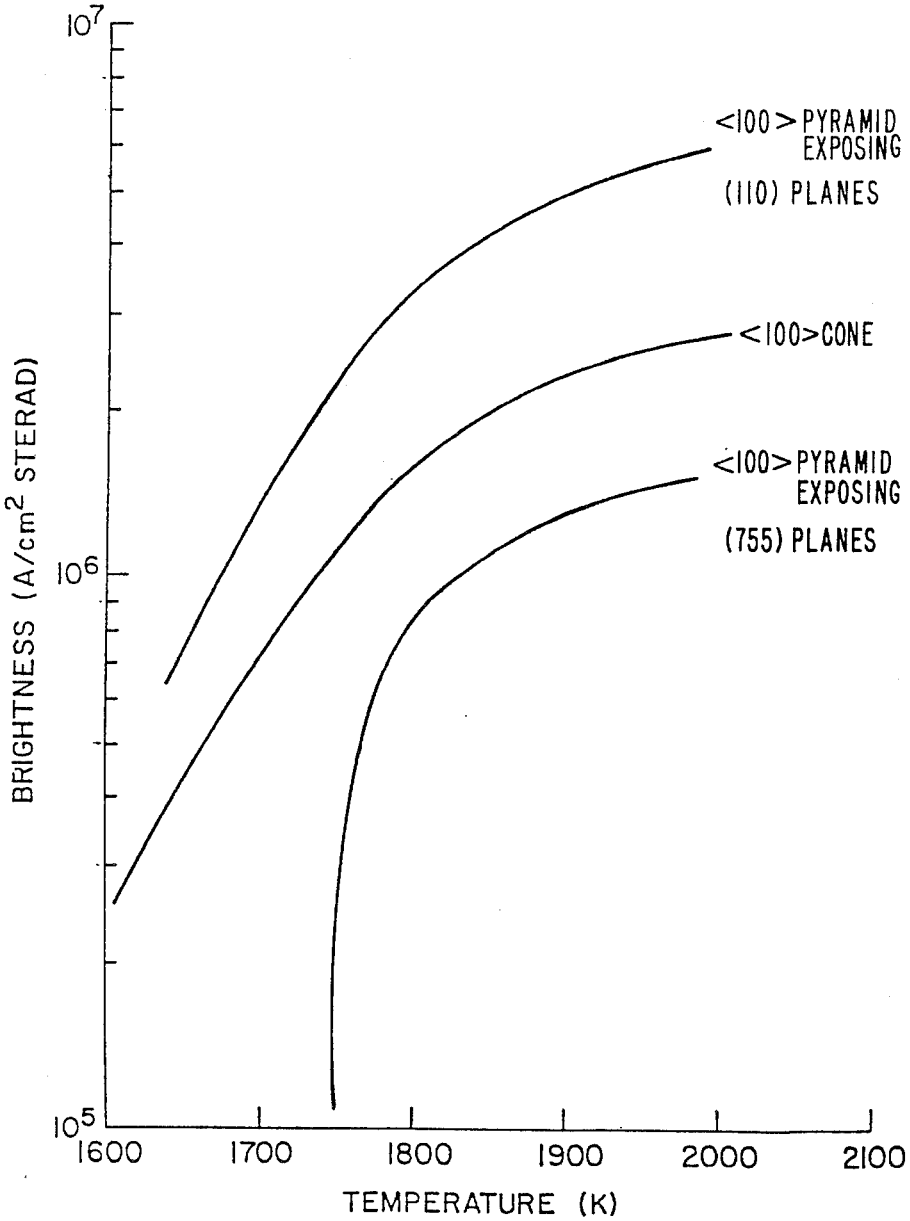

It should be observed that the pyramidal tips illustrated in FIGS. 5.2–5.4 expose (100) and (110) crystal planes, which are known to be two of the lowest work function crystal planes for $LaB_6$. In order to dramatically illustrate the dependence of brightness on the particular selection of crystal planes exposed, a crystal tip was deliberately prepared which exposes only $LaB_6$ crystal planes which have a relatively high work function, namely (755) crystal planes. These planes were selected because the included angle between the exposed faces andthe pyramid axis is 45° and because this pyramid also has four sides. This tip geometry is illustrated in FIG. 5.5. Since brightness was measured again at 20 kV and 200 μA, a direct comparison can be made with previously described results. FIG. 9 is a graph comparing measured brightness as a function of temperature for the tips illustrated in FIGS. 5.1, 5.2, and 5.5. Since these cathodes all had a similar apex, namely spherical with a 2–3 μm radius, the same <100> orientation, the same number of facets, the same included angle for the facets, and the same operating conditions, the low measured brightness for the tip exposing only (755) crystal planes in comparison with the tip exposing only (100) crystal planes is attributed to the selection of relatively high work function crystal planes for exposure in the one sample and the relatively low work function crystal planes for exposure in the other sample. It should be noted that a cone tip exposes a continuum of crystal planes around the cone surface. Since the cone shaped tip exposes a mixture of both relatively low and relatively high work function planes, it would be expected that the brightness for the cone shape represents some kind of average. As illustrated in FIG. 9, the measured brightness for the cone shaped configuration does indeed fall between the other two.

Figure 10:
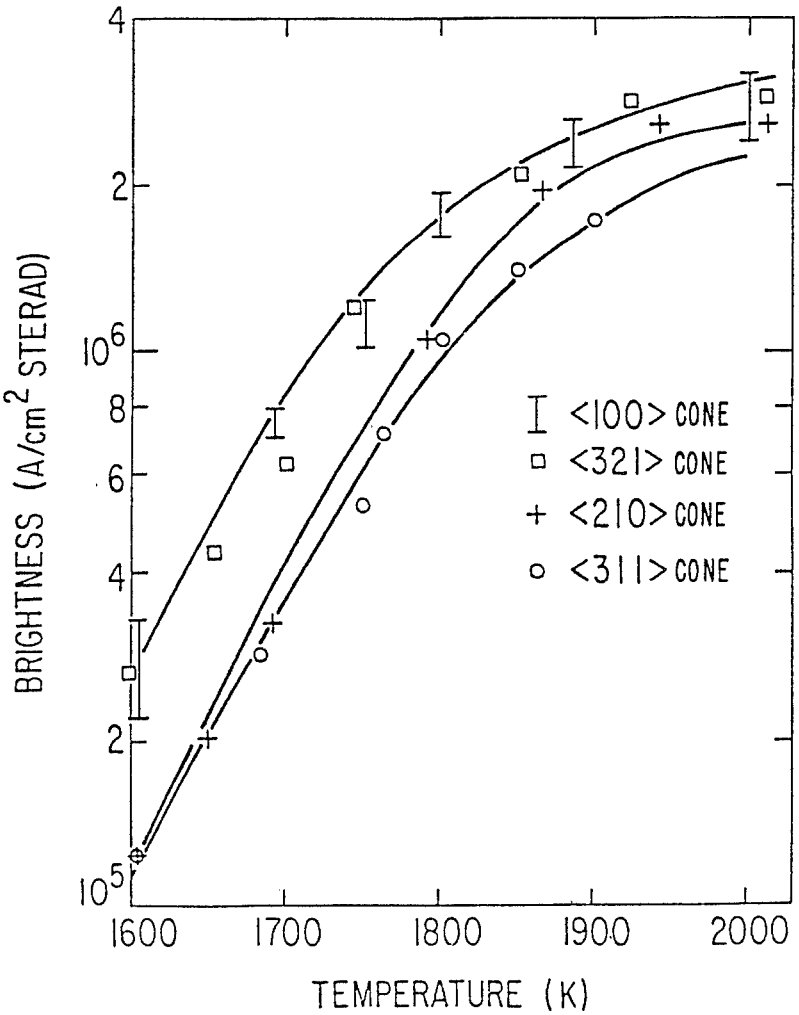

FIG. 10 is a graph comparing measured brightness as a function of temperature for single crystal cathodes having cone shaped tips and various crystal orientations including <100>, <321>, <210>, and <311> orientations. The <100> and <321> orientations produce approximately the same brightness curve while the brightness for the <210> and <311> orientations is somewhat lower though still better at moderate or high temperatures than a sintered cathode having a cone tip. These curves and the cone shaped tip curves in FIG. 6 may be directly compared since they all correspond to identical tip geometry and operating conditions. The axis of the electron beam is always coincident with the axis of the cone tip and the cathodes were all operated at 20 kV and 200 μA. Since the only difference is in the crystal orientation, it is apparent that apart from tip geometry, the orientation of the crystal with respect to the axis of the electron beam also has a significant effect upon brightness. The crystal orientations which result in relatively high brightness are the orientations which have a low work function crystal plane perpendicular to the electron beam axis. Since all of the single crystal cone shaped tip curves have higher brightness than the sintered cone shaped tip curve, it is apparent that the work functions of the associated individual crystal planes are all lower than the average work function for all $LaB_6$ crystal planes (represented by sintered material). Thus, among the crystal planes which can be considered as having a relatively low work function (lower than the average work function for sintered $LaB_6$) are the (100), (110), (111), (321), (210), and (311) crystal planes. I expect that additional $LaB_6$ crystal planes will also be considered as having relatively low work function when it is established that they have a lower work function than the average work function for sintered $LaB_6$.

The present invention in effect reduces the effective average of the work functions around the tip by maximizing the amount of emitting tip area having a relatively low work function and minimizing the amount of emitting tip area having a relatively high work function. This is done by selecting crystal planes having relatively low work functions and maximizing the tip area exposing such crystal planes by forming flat surfaces or facets corresponding to such crystal planes.

In view of the importance of crystallographic orientation with respect to the electron beam axis, as well, it might seem that a large area flat surface corresponding to the lowest work function plane and oriented perpendicular to the electron beam direction would produce the highest possible brightness. This has not been verified. My experiments with this geometry have only resulted in destroying the wehnelt electrode. My experiments have suggested that for highest brightness, there must be a contribution of electrons to the beam from side surface area oblique to the electron beam axis. In order to maximize the relatively low work function emitting area, this oblique side surface area is preferably formed as flat surfaces or facets corresponding to and thereby exposing relatively low work function crystal planes. Obviously, the entire oblique side surface region of the emitting surface need not be facetted in order to get some improvement in brightness. However, as more of the oblique side surface emitting region is facetted with relatively low work function planes, more improvement can be expected in brightness.

The emitting region of a facetted $LaB_6$ single crystal tip is illustrated in FIGS. 11.1 and 11.2. Region 110, defined as the region above the dotted line, is the emitting region. The apex itself can be rounded (FIG. 11.1) or flat (FIG. 11.2). A flat apex theoretically would be expected to have better brightness but such an apex cannot be made very well with present techniques, at least not without greatly increasing the top plateau 112 size with respect to the smallest size rounded tip which can be fabricated. Emission density at the apex is very much affected by the size of the apex. All things considered, a tip with a smaller round apex has better brightness than a tip with a flat but larger plateau. Although as a practical matter I have not achieved higher brightness with a plateau at the apex, I have found that a plateau at the apex may be used very effectively to perform a beam shaping function or to affect the intensity distribution at the cross-over. These aspects are particularly described and claimed in my copending application entitled, "Shaped Electron Emission From Single Crystal Lanthanum Hexaboride With Uniform Intensity Distribution", filed simultaneously herewith.

It should be apparent to those of ordinary skill in this art that many changes and modifications could be made without departing from the spirit and scope of my invention as defined in particular by the following claims.

Having thus described my invention, what I claim as new, and desire to secure by Letters Patent is:

1. Electron beam emission apparatus comprising a lanthanum hexaboride single crystal cathode for emitting an electron beam along a beam axis characterized in that the emitting surface of the lanthanum hexaboride cathode comprises at least two flat surfaces oblique to said beam axis and each of said two flat surfaces exposes a crystal plane selected from the group of crystal planes consisting of the (100), (110), (111), (321), (210), and (311) crystal planes.

2. Electron beam emission apparatus as defined in claim 1 wherein each of said two flat surfaces exposes a crystal plane selected from the group of crystal planes consisting of the (100), (110), (210), and (321) crystal planes.

3. Electron beam emission apparatus as defined in claim 1 wherein the beam axis is normal to either the (100), (110) or (111) crystal planes.

4. Electron beam emission apparatus as defined in claim 1 wherein the emitting surface further comprises a flat surface normal to the beam axis.

5. Electron beam emission apparatus as defined in claim 4 wherein said flat surface normal to the beam axis exposes a crystal plane selected from the group of crystal planes consisting of the (100), (110), (111), (321), (210), and (311) crystal planes.

6. Electron beam emission apparatus as defined in claim 1 wherein said flat surfaces oblique to said beam axis improve the brightness of said emitted electron beam.

7. Electron beam emission apparatus as defined in claim 1 wherein said electron beam has a brightness higher than $3\times10^8$ a/cm$^2$ sterad.

8. Electron beam emission apparatus as defined in claim 1 wherein the emitting region of the lanthanum hexaboride cathode has a pyramid shape with the apex of said pyramid pointing in the direction of the emitted beam.

9. Electron beam emission apparatus as defined in claim 8 wherein said pyramid is truncated with a flat surface.

10. Electron beam emission apparatus as defined in claim 8 wherein said pyramid has a rounded apex.

11. Electron beam emission apparatus as defined in claim 8 wherein said pyramid has three flat side surfaces symmetrically positioned around an axis which passes through the apex of said pyramid, said axis coinciding with said beam axis.

12. Electron beam emission apparatus as defined in claim 8 wherein said pyramid has four flat side surfaces symmetrically positioned around an axis which passes through the apex of said pyramid, said axis coinciding with said beam axis.

13. Electron beam emission apparatus as defined in claim 1 wherein said flat surfaces oblique to said beam axis comprise four flat surfaces and each of said four flat surfaces exposes a (110) crystal plane.

14. Electron beam emission apparatus as defined in claim 13 wherein said beam axis coincides with a <100> crystal direction.

15. Electron beam emission apparatus as defined in claim 1 wherein said two flat surfaces oblique to said beam axis each exposes a (100) crystal plane and said beam axis coincides with a <100> crystal direction.

16. Electron beam emission apparatus as defined in claim 1 wherein said flat surfaces oblique to said beam axis comprise three flat surfaces and each of said three flat surfaces exposes a (100) crystal plane.

17. Electron beam emission apparatus as defined in claim 16 wherein said beam axis coincides with a <111> crystal direction.

18. A method for increasing the brightness of an electron beam emitted from a single crystal lanthanum hexaboride cathode comprising the step of:

forming flat facets on the electron beam emitting portion of the cathode tip, each of said flat facets exposing a crystal plane selected from the group of crystal planes consisting of the (100), (110), (111), (321), (210), and ( 311) crystal planes.

* * * * *